United States Patent [19]

Becker

[11] 4,332,534

[45] Jun. 1, 1982

[54] MEMBRANE PUMP WITH TILTABLE ROLLING PISTON PRESSING THE MEMBRANE

[76] Inventor: Erich Becker, Glöcklehofweg 13, 7812 Bad Krozingen, Fed. Rep. of Germany

[21] Appl. No.: 102,951

[22] Filed: Dec. 12, 1979

[30] Foreign Application Priority Data

Dec. 14, 1978 [DE] Fed. Rep. of Germany ..... 2853916
Mar. 24, 1979 [DE] Fed. Rep. of Germany ..... 2911609
Nov. 8, 1979 [DE] Fed. Rep. of Germany ..... 2945042

[51] Int. Cl.[3] ..... F04C 5/00
[52] U.S. Cl. ..... 418/45; 418/153
[58] Field of Search ..... 418/45, 153, 156; 417/474–477

[56] References Cited

U.S. PATENT DOCUMENTS 664,507 12/1900 Singer ..... 417/476
3,408,947 11/1968 McMillan ..... 418/45
3,597,123 8/1971 Lutz ..... 417/475
3,644,061 2/1972 McFarlin ..... 418/45

FOREIGN PATENT DOCUMENTS 860457 9/1940 France ..... 418/45
180550 6/1922 United Kingdom ..... 417/476
785597 10/1957 United Kingdom ..... 418/45

*Primary Examiner*—John J. Vrablik

*Attorney, Agent, or Firm*—Michael J. Striker

[57] ABSTRACT

A membrane pump comprising a housing having an inner cylindrical surface, an annular member in the housing and having an outer surface defining with the inner surface of the housing a working space. A hollow rolling piston is arranged in the interior of said annular membrane. An eccentric drive including an arm fixed at one end to a drive shaft carries at its other end a roller engaging the inner surface of the rolling piston for rotating the latter about its axis while pressing the outer surface thereof against the inner surface of the membrane, whereby the outer surface of the membrane is pressed at a revolving sealing region against the inner surface of the housing. The membrane has a clamping portion projecting from the outer surface thereof and being sealingly secured in a corresponding cutout of the housing, so that the working space is divided between the clamping portion and the sealing region in a suction compartment and a pressure compartment with which inlet and outlet passages respectively communicate. The rolling piston is arranged tiltable with respect to the inner surface of the housing and the eccentric drive means so that the sealing region at which the membrane is pressed against the inner surface of the housing trails the point of contact of the roller with the inner surface of the rolling piston as considered in the direction of movement of the latter along the inner surface of the membrane.

35 Claims, 21 Drawing Figures

1
D
B
OT
20
3
21
8
47
7
6a
27
4
8
6b
34
19
C
48
13
9
11
26
d
18
6
7
6
9
9
R1
10
M
R2
16
12
III
III
10
Pf1
Pf4
14
Pf2
17
Pr
37a
F
A

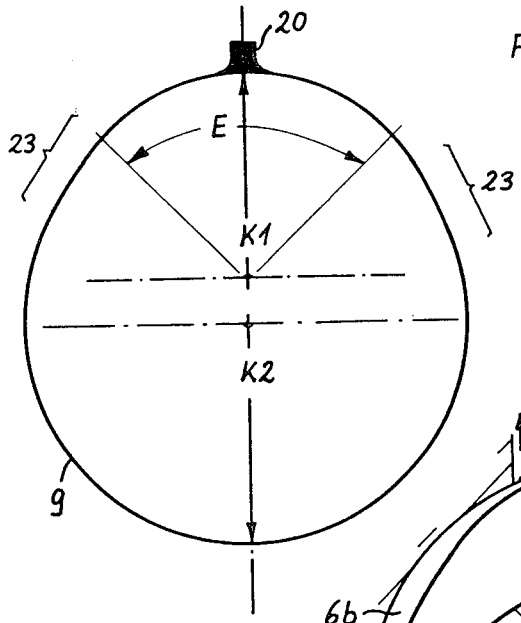
Fig. 8
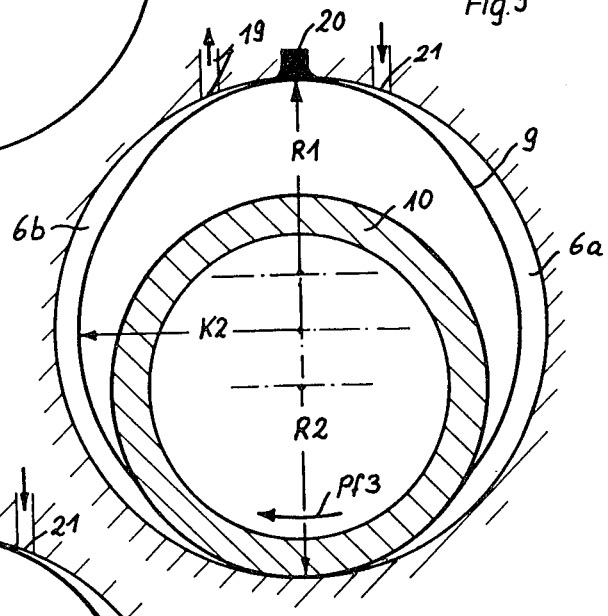
Fig. 9
Fig. 10
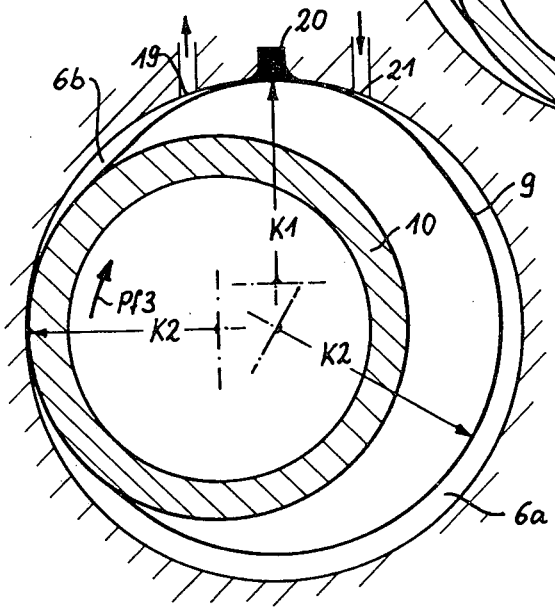

25
24a
24b
26
20
44
9a

Q
10
45
6b
9a
34

9a
38
24b
24
24a
20
E
XX
25

MEMBRANE PUMP WITH TILTABLE ROLLING PISTON PRESSING THE MEMBRANE

BACKGROUND OF THE INVENTION

The present invention relates to a membrane pump with an annular working space formed between the inner surface of the pump housing and a deformable annular membrane located therein, whereby a pressure member driven by an eccentric drive presses the outer surface of the annular membrane at a revolving sealing region against the inner surface of the outer housing.

Such pumps having an annular working space with a yieldable inner wall which by a pressure member is pressed against the rigid outer housing wall is already known in the art. In this known construction a plurality of coaxial discs arranged with different eccentricities on a drive shaft serve as pressure member. This known pump has many disadvantages. The pressure member having a plurality of eccentricities results in an expensive construction. An essential further disadvantage resides in the high stressing of the membrane, which for instance occurs due to a considerable fulling of the latter during operation of the pump. In addition, a considerable loading of the membrane occurs due to its great surface abutting against the pressure member and the therefrom resulting considerable friction.

SUMMARY OF THE INVENTION

It is therefore an object of the present invention to provide a membrane pump which avoids the disadvantages of the membrane pump known in the art.

It is a further object of the present invention to provide a membrane pump by means of which high pressure differences may be produced and which is nevertheless simple in its construction while stressing the membrane to a relatively little extent.

It is an additional object of the present invention to provide a membrane pump in which wear of the various members thereof will not cause a reduction of the output.

With these and other objects in view, which will become apparent as the description proceeds, the membrane pump according to the present invention mainly comprises a housing having an inner annular surface, an annular membrane within said housing and having an outer surface defining with said inner surface of the housing an annular working space, and means rotatable in one direction for pressing the outer surface of the membrane at a revolving sealing region against the inner surface of the housing, in which the rotatable means comprise a rolling piston and an eccentric drive for rotating the rolling piston about its axis while pressing its outer surface against the inner surface of the membrane, the rolling piston being tiltable with respect to the inner surface of the housing and the eccentric drive means.

This construction therefore creates an additional "degree of freedom" for the movement of the rolling piston so that the latter may additionally tilt within the plane of its rotation. Due to the tilting movement of the rolling piston, the sealing region is displaced with respect to the engagement region of the eccentric drive with the rolling piston to thus provide a compensation for play without essentially influencing the sealing between the cooperating pump members. In addition, the stress on the membrane is thereby considerably reduced so that the useful life of the membrane is increased. Due to the tilting movement of the rolling piston an eventually provided play may be compensated and nevertheless the sealing region be properly maintained.

Preferably the rolling piston is hollow and has an outer circular cylindrical surface and an inner surface coaxial therewith and the eccentric is turnable about an axis coaxial with the axis of the inner surface of the housing and has an eccentric portion revolvingly engaging the inner surface of the rolling piston.

The eccentric drive with the rolling piston drive element can therefore be mounted within the rolling piston, thus resulting in a very simple construction.

In order to permit the above-mentioned tilting movement of the rolling piston, the outer radius of the eccentric drive, plus the wall thickness of the hollow piston, plus the wall thickness of the membrane is in at least one radial cross-section and preferably in all radial cross-sections through the housing about equal, preferably under forming of a small clearance a little smaller than the respective diameter of the inner surface of the housing.

The tolerances for manufacturing of these pump parts can thereby be held as minus tolerances, which essentially facilitates the manufacture of these pump parts. Any tolerances are compensated by corresponding tilting movement of the rolling piston, so that the fluid-tightness of the pump is not detrimentally influenced by any of the tolerances according to which the pump parts are manufactured. Even if practically no play is provided, then, due to the elasticity of the membrane, there will usually result a trailing of the rolling piston.

In accordance with a further feature of the present invention the form of the membrane and the membrane diameter at least with respect to the cross-section thereof is chosen in such a manner that at least in most of the positions of the rolling piston the membrane remains substantially free of stress.

The loading of the membrane is thereby essentially reduced which will assure an increased useful life thereof.

Preferably, the inner surface of the housing is in a longitudinal section therethrough concavely formed and the outer surface of the rolling piston is, under consideration of the wall thickness of the membrane, correspondingly convexly formed. The output of the pump is thereby increased.

The useful life of the membrane is further in creased in that the inner surface of the membrane is a smooth surface whereby also a quiet travel of the rolling piston is obtained.

It has been proven advantageous that the annular membrane is formed from an elastic material, preferably an elastomer, and has preferably a thickness of 1 to 4 millimeters.

Such a membrane has the necessary flexibility, whereby at the same time it is assured that the membrane especially at the suction side, will detach itself from the inner surface of the housing.

In order to obtain the last result it is also advantageous if the membrane is in circumferential direction substantially nonextensible, but extensible in radial direction and that annular reinforcements, for instance threads or fabric, are embedded in the membrane. An undesired and for the operation of the pump unnecessary stretching of the membrane can thus be avoided.

A further advantageous feature of the invention consists in that the pump housing and/or the rolling piston, preferably both of these pump parts, are constituted by cast parts, especially metal cast parts and preferably by non-machined die cast metal parts. This will result in relatively small manufacturing costs, whereby eventual resulting tolerances and deviations from the circular form of the inner surface of the housing and the outer surface of the rolling piston are compensated for by the arrangement of the rolling piston according to the present invention.

In order to reduce the stretchability of the annular membrane in circumferential direction, the membrane may be provided with an at least one annular bead.

This annular bead is preferably provided at the inner surface of the membrane and has a cross-section as well as a moment of inertia in order to lift the sections of the membrane which are not engaged by the rolling piston from the inner surface of the housing. Thereby it is essential that the deformation energy remains as small as possible, but, that even if the pump sucks from a vaccum, the corresponding membrane section will be lifted from the inner surface of the housing. In this case it is possible to construct the membrane without reinforcements embedded therein.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is a schematic view of a cross-section through the membrane in unassembled unstressed condition;

FIG. 9 is a schematic side view shown in section of a membrane pump with the rolling piston in the lower dead center position;

FIG. 10 is a side view similar to FIG. 9 with a rolling piston through 90° displaced in its revolving direction with regard to that shown in FIG. 9;

DESCRIPTION OF THE PREFERRED EMBODIMENTS

Figure 1:
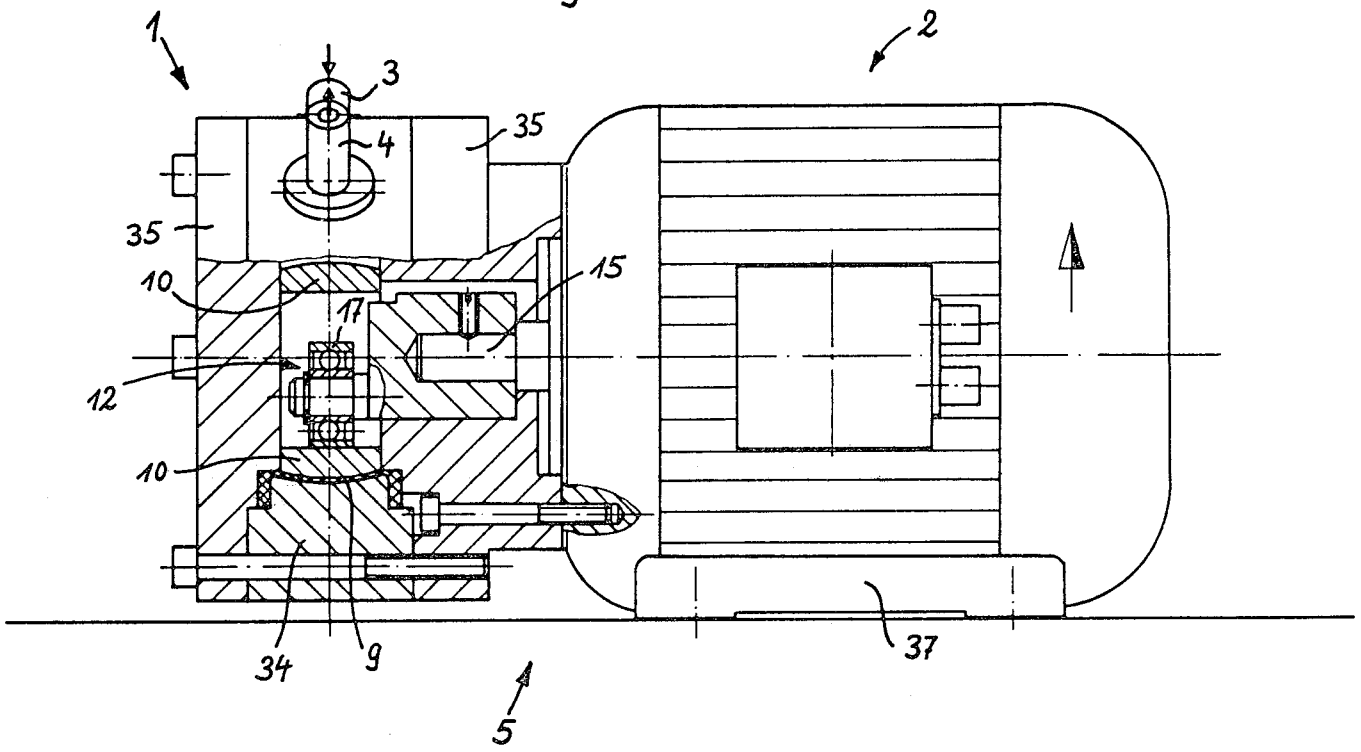
FIG. 1 is a partly sectioned side view of the pump according to the present invention.
Figure 2:
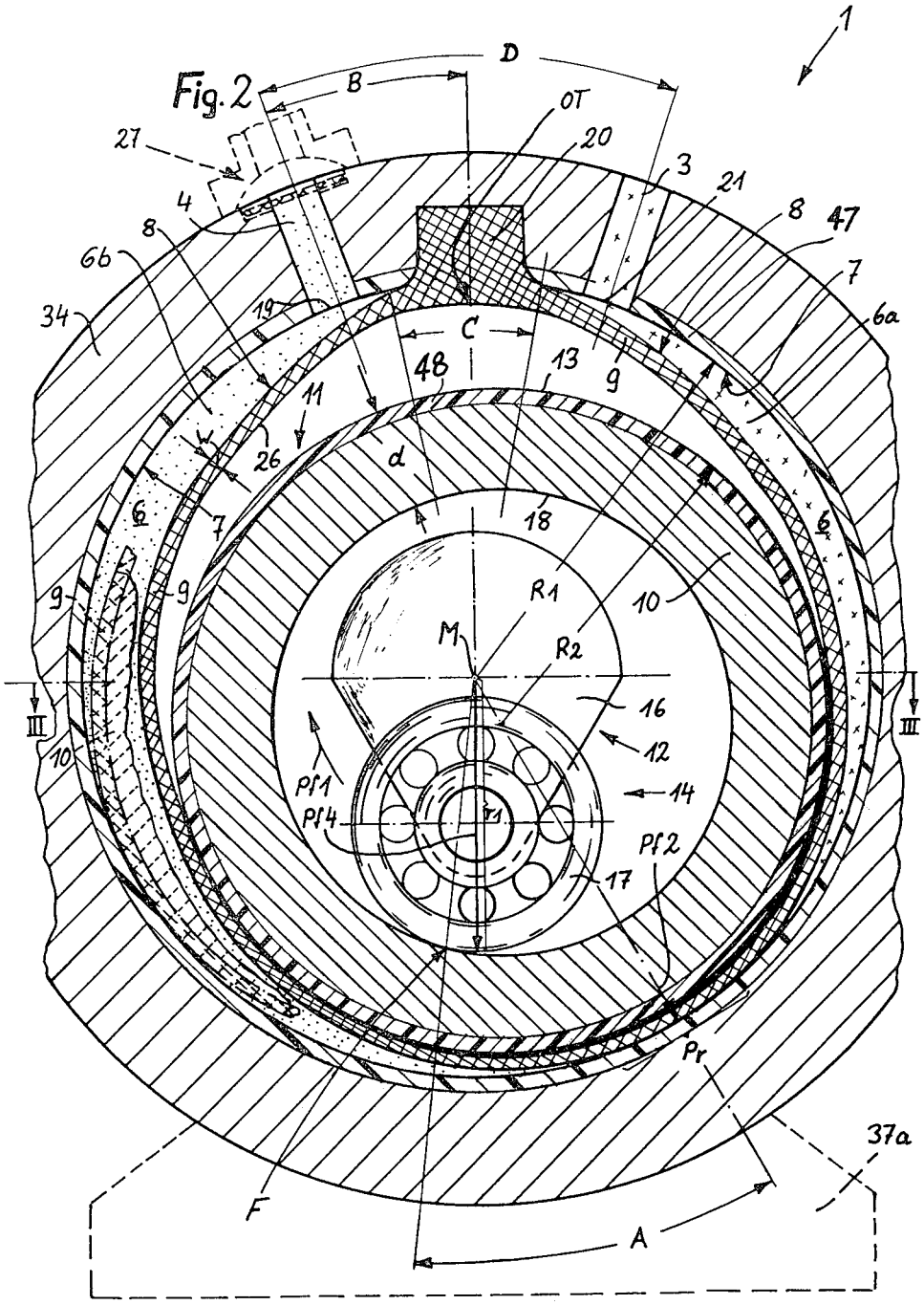
FIG. 2 is a cross-section taken along the line II—II of FIG. 3 and drawn to a larger scale than FIG. 1.
Figure 3:
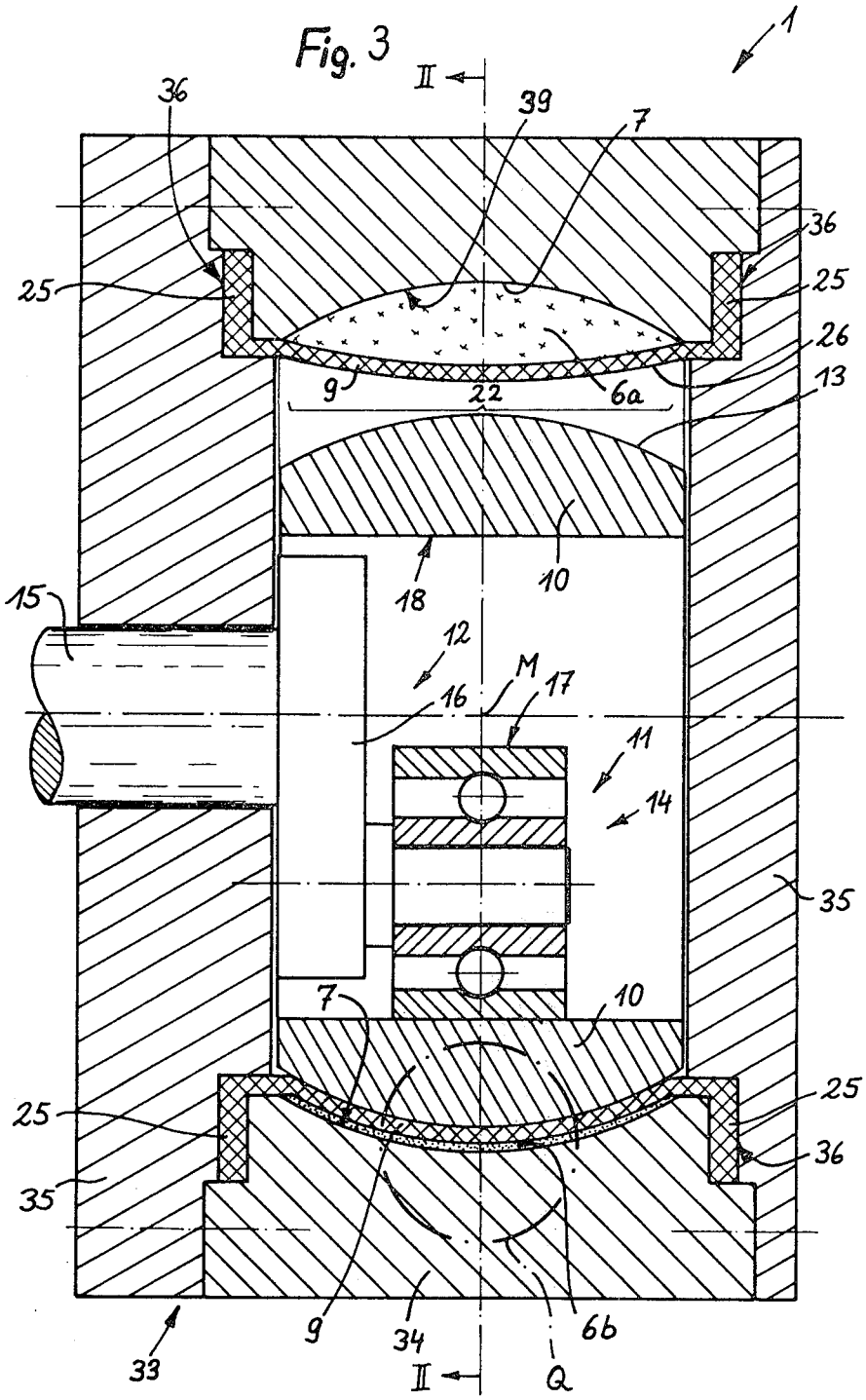
FIG. 3 is a longitudinal section of the pump according to the line III—III in FIG. 2.

Referring now to the drawing and more specifically to FIGS. 1–3 of the same, it will be seen from FIG. 1 that the membrane pump 1 is provided with a drive motor 2 connected to a flange of the membrane pump. The pump 1 has a suction socket 3 as well as a pressure socket 4 located in the same plane as the socket 3. The pump 1 and the drive motor 2 form a motor-pump aggregate. The motor 2 has a foot 37 by means of which it may be connected to the floor.

The inner construction of the pump 1 can best be visualized from FIGS. 2 and 3. The pump 1 has an annular working space 6 defined between the inner surface 7 constituted by a smooth layer of plastic material 47 of the pump housing 34 and the deformable outer surface 8 of an annular membrane 9.

The annular membrane 9 is revolvingly pressed by a pressure member 11 constituted by a rolling piston 10 against the inner surface 7 of the housing. The rolling piston 10 is covered at its outer surface with a smooth layer of plastic material 48. An eccentric drive 12 serves as drive for the rolling piston 10. The eccentric drive 12 is located within the interior of the hollow rolling piston which has an inner surface 18 coaxially arranged with the outer surface 13 thereof. The eccentric drive 12 comprises a rolling piston drive elemt 14. The latter includes a drive shaft 15, an arm 16 connected to the inner end of the drive shaft and extending substantially normal to the axis thereof and carrying at its free end a roller, preferably a ball bearing 17. When the eccentric drive 12 is moved in the direction as indicated by the arrow Pf1, the ball bearing 17 rolls on the inner surface 18 of the rolling piston 10. Correspondingly the annular membrane 9 is also revolvingly pressed in a sealing region Pr against the inner surface 7 of the housing. From this results a displacement of the fluid medium in the working space 6, especially in the pressure compartment **6*b* thereof. This fluid medium to be pumped by the pump is indicated by dots in the pressure compartment 6*b* and in the suction compartment 6*a*** by small crosses.

Figure 12:
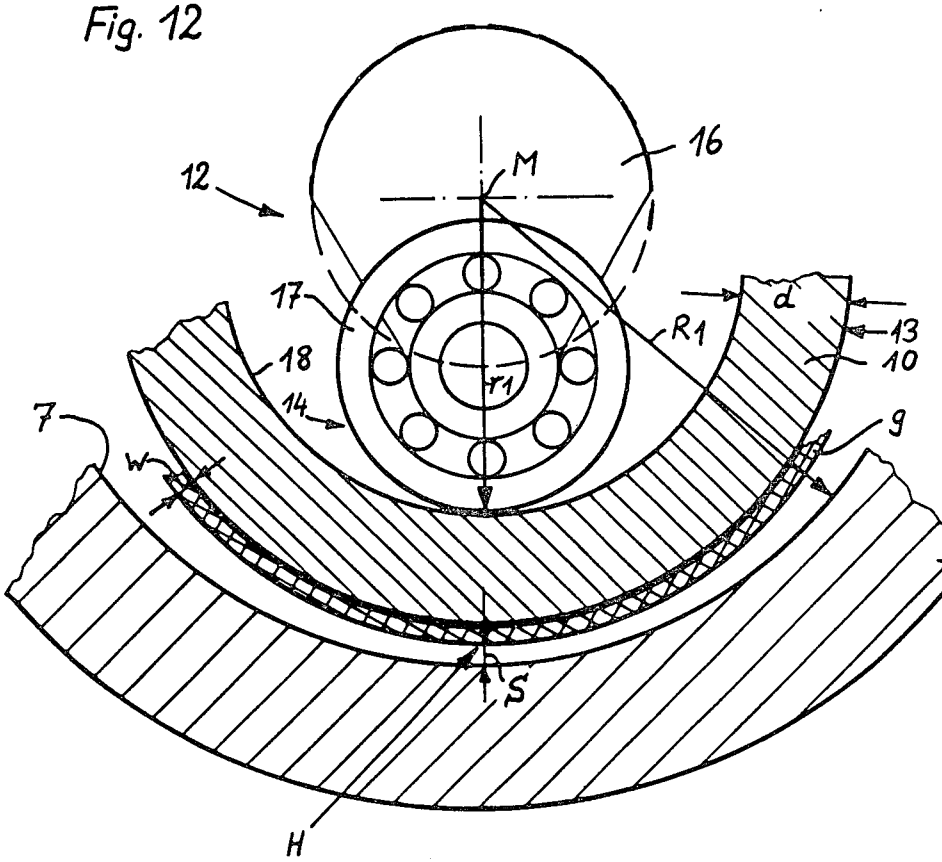
FIG. 12 is a partial cross-section through a membrane pump shown in a rest position.

The rolling piston 10 is according to the present invention tiltably arranged relative to the inner surface 7 of the housing as well as relative to the rolling piston drive element 14. At this possible tilting movement the inner surface 18 of the rolling piston will roll off the outer surface of the ball bearing 17, whereas the outer surface 13 of the rolling piston 10 will roll off of the inner surface of the outer housing with the annular membrane sandwiched therebetween. The tilting movement in the plane of rotation of the rolling piston 10 is obtained by the following diametrical arrangement: The outer radius r1 (arrow Pf4 in FIG. 2) of the eccentric drive 12, plus the respective thickness d of the rolling piston 10, plus the respective wall thickness w of the annular membrane 9 is about equal but preferably slightly smaller than the respective radius R1 of the inner surface 7 of the housing. This will provide between the pump parts 12, 17, 10 and 9 on the one hand, and the inner surface 7 of the housing some clearance S as indicated by the position of these members as shown in FIG. 12. In the position as shown in FIG. 12 the rolling piston 10 is shown in a neutral position in which it is not tilted relative to the rolling piston drive element 14. Due to this clearance S the membrane 9 is not pressed against the inner surface 7 of the housing. The position of the rolling piston as shown in FIG. 12 illustrates therefore not an actual position occurring during operation of the pump, but this illustration serves only to explain the operation of the pump.

The clearance S permits the above mentioned tilting movement of the rolling piston 10 with respect to the ball bearing 17 on the one hand and with respect to the inner surface 7 of the housing on the other hand. Even if the aforementioned clearance S between the mentioned pump parts is practically zero, a small tilting movement of the rolling piston 10 will still be possible due to the pressure elasticity of the annular membrane 9. From this it will be evident that the amount of the possible tilting movement of the rolling piston will depend on the above-mentioned clearance S. The clearance S is thereby the radius R1 of the inner surface 7 of the housing minus the sum of the radius r1, the thickness d of the rolling piston 10 and the wall thickness W of the annular membrane 9 (FIG. 12). This clearance S may have in actual practice a dimension which is about 0 to 1.5 millimeters. From this clearance results the trailing angle A (FIG. 2) between the line of abutment F of the rolling piston drive element 14, especially the ball bearing 17, and the inner surface 18 of the rolling piston and the center of the region Pr at which the rolling piston 10 presses the annular membrane 9 against the inner surface 7 of the housing, which trailing angle may be between 1° and a maximum angle of about 40°.

The tilting of the rolling piston 10 as shown in its trailing position with the trailing angle A in FIG. 2 results on the one hand from the direction of rotation of the eccentric drive 12, and on the other hand, also on the pressure conditions in the suction and pressure compartments *6a* and *6b*. These pressure conditions will also influence the sealing pressure in the pressure region Pr. Assuming all other conditions remain the same, the sealing pressure in the pressure region Pr increases with increase of the pressure difference between the suction compartment *6a* and the pressure compartment *6b*. The pump according to the present invention permits thereby an adaptation of the sealing pressure in the pressure region Pr to respective operating condition of the pump without any constructive changes thereof. At small pressure differences between the suction side and the pressure side there will result a correspondingly reduced sealing pressure, whereas at larger pressure differences between the suction and the pressure side a corresponding higher sealing pressure will become active.

The thus produced sealing pressure depending on the operating conditions of the pump will also result in a reduction of the wear of the annular membrane 9 since the latter is only pressurized according to the required sealing conditions. In addition, the necessary driving power for the drive motor is reduced especially during idling of the pump.

The sealing pressure is the pressure region Pr in the direction as indicated by the arrow Pf2 depends further on the magnitude of the trailing angle A. At different trailing angles A there will result, in correspondence with the different lever arms, a change in the sealing pressure which is inversely proportional to the trailing angle A. At a small trailing angle A the sealing pressure is at otherwise the same condition therefore greater than at a greater trailing angle A. This will be further explained later on in connection with FIG. 13.

For reason of a clear illustration, the trailing angle A is shown in FIG. 2 larger than in actual practice. In actual practice it has been shown that especially a trailing angle A in the region of about 10 degrees is especially advantageous.

A trailing angle A which is held to a minimum has also advantages in the region of the upper dead center position OT of the rolling piston 10, in which also the suction opening 3 and the pressure opening 4 are provided through the wall of the housing. In this upper dead center position OT occurs a change of the forces acting on the rolling piston 10 to that the latter tends to carry out a corresponding compensating tilting movement. Depending on a preferably small trailing angle A this tilting movement will be held within narrow limits. In addition an especially formed annular member 9 in the region of the upper dead center position OT, as will be described later on, will result in a good guiding of the rolling piston so that the above mentioned compensating tilting movement thereof will at least be dampened.

For the same purpose it is advantageous if the circumferential angle B between the outlet opening 19 and the center line of the clamping portion 20 of the annular membrane is greater than the trailing angle A, and the latter is preferably smaller than the circumferential section with the angle C in which the clamping portion 20 of the annular member 9 is arranged. The force acting on the rolling piston 10, which eventually results in the compensation tilting movement of the latter will thereby be transferred in an advantageous manner into the region after the outlet opening 19 and especially into the region of the clamping member 20.

The circumferential angle D between the inlet and the outlet opening 21, respectively 19 is usually held, under consideration of the circumferential extent of the clamping portion 20, as small as possible. Correspondingly the active working volume of the membrane pump is relatively great. The circumferential angle D may eventually be adapted to the desired end pressure of the pump 1.

As shown in FIG. 3 the inner surface 7 is concavely curved. Correspondingly, the outer surface 13 of the rolling piston 10 has a contour which, under consideration of the wall thickness w of the annular membrane 9, is convexly curved. The various coaxial cross-sections of the surface 7 are circular and coaxial with the axis of the drive shaft 15 of the rolling piston drive element 14. As can also be clearly visualized from FIG. 3, the annular membrane 9 has in its region 22 substantially the same wall thickness w.

The rolling piston 10 is shown in FIG. 3 in a position turned about through an angle of 90 degrees with respect to the position shown in FIG. 2, as is also indicated in FIG. 2 in dotted lines for a membrane and rolling piston section.

According to an essential characteristic of the present invention, the membrane is constructed with respect to its form and its diameter, as well as its cross-section, so that at least in nearly all turned position of the rolling piston 10 the membrane will be substantially unstressed. The therefore necessary form of the membrane is schematically illustrated in FIG. 8. Thereby the membrane 9 has especially in its active region 22 (FIG. 3) a substantially pear-shaped outline. Thereby a substantially circular circumferential region with a smaller radius of curvature K1 is mirror-symmetrically provided to opposite sides of the clamping portion 20 and oppositely therefrom is a section with a larger radius of curvature K2 connected to the above-mentioned section by preferably tangential transition sections 23. The radius of curvature K2 of the membrane 9 is smaller than the radius R1 of the inner surface 7 but greater than the radius R2 of the outer surface 13 of the rolling piston 10. The smaller radius of curvature K1 of the annular membrane corresponds at most to the radius of curvature R2 of the outer surface 13 of the rolling piston 10, but is preferably smaller than the radius R2. The above-mentioned shape of the membrane as well as the diameter relationships thereof are provided to assure that the membrane will remain substantially tensionless in all positions of the rolling piston with respect thereto and to increase the output of the pump. The circumferential section with the smaller radius of curvature K1 extends through an angle E of about 70 degrees. Since the radius of curvature K1 of the membrane 9 is smaller than the radius R1, a detachment of the membrane 9 from the inner surface 7 is favored especially in the suction compartment **6*a* of the pump. The larger radius of curvature K2 of the membrane is chosen to obtain the most possible freedom of tension of the membrane 9** in circumferential direction as well as under consideration of a predetermined output of the pump.

Figure 4:
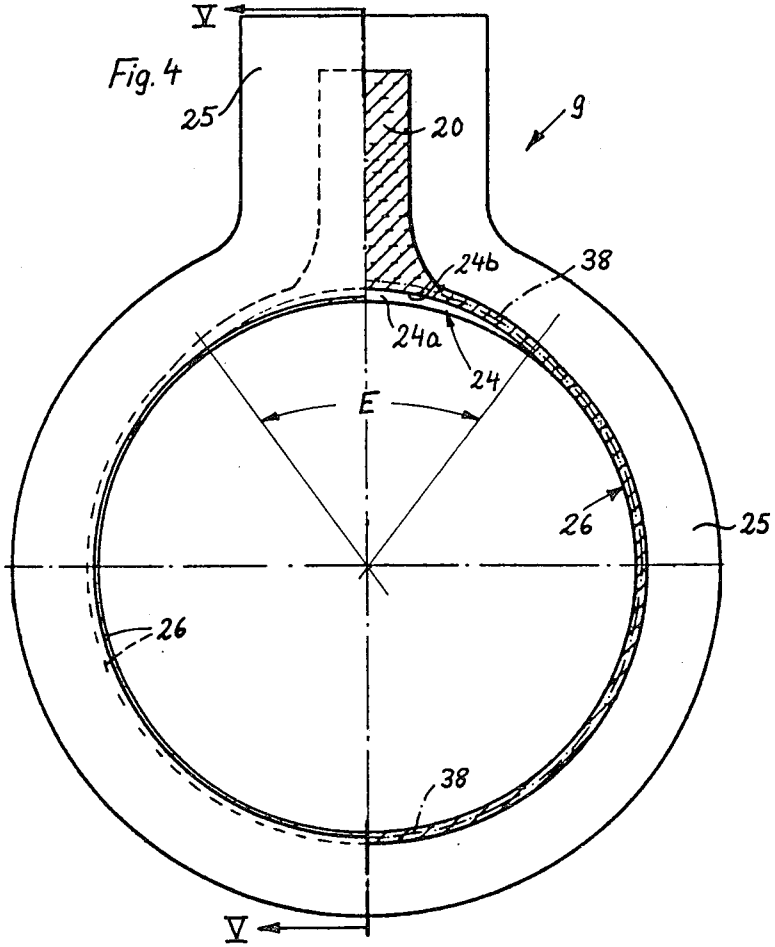
FIG. 4 is a partly sectioned side view of the membrane in undeformed condition.
Figure 6:
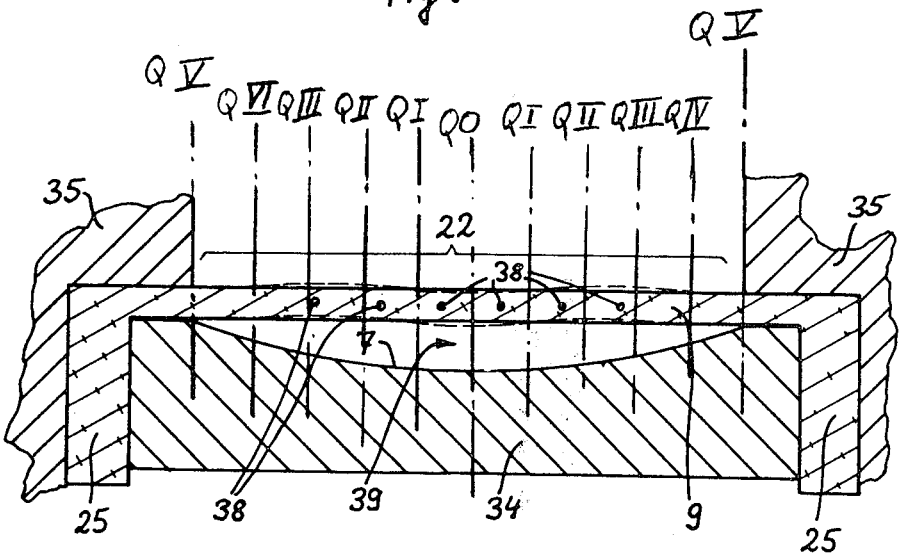
FIG. 6 is an enlarged partial section of the clamped membrane in the region of the lower half of the pump as shown in FIG. 2, whereby the scale in radial direction is considerably exaggerated.

The annular membrane 9 has in the active region 22 thereof as viewed in axial direction which is provided with the greater radius of curvature K2, in unstressed condition (FIG. 8) a straight cylindrical inner surface as shown in FIG. 6. However, the circumferential region with the smaller radius of curvature K1 extending through the angle E about mirror-symmetrically to the clamping portion 20, has in correspondence with the curvature 39 of the inner surface 7 also in undeformed condition a radially curved contour increasing toward the clamping section 20 and at the clamping section 20 a curvature 24 corresponding to the curvature of the inner surface 7 of the housing. In FIG. 4 the curved space of the curvature 24 is designated with **24*a* and the surface of the curvature with 24*b***.

Figure 7:
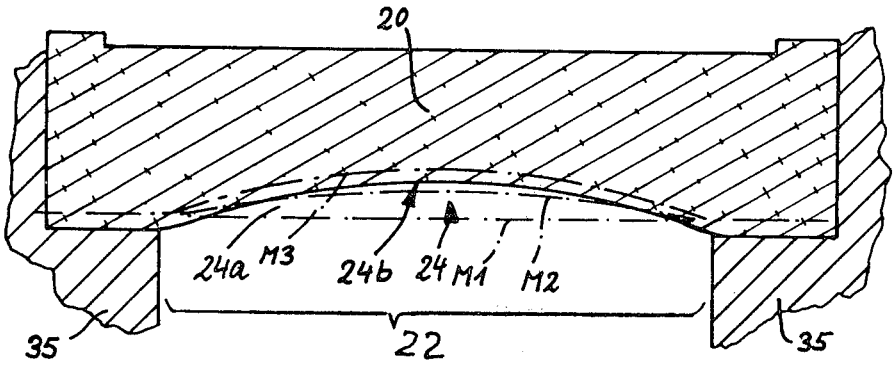
FIG. 7 is a partial longitudinal section of the membrane in the region of the clamping portion thereof.

FIG. 7 shows in dash-dotted lines the center lines of active regions 22 of the annular membrane in respective sections of the latter which are spaced in circumferential direction at different distances from the clamping portion 20 of the membrane. The center line M1 belongs thereby to a circumferential section of the membrane with the radius of curvature K2, whereas the center line M2 relates to a membrane section adjacent to the clamping portion 20. The center line M3 illustrates the curvature of the arching **24*a* directly in the center of the clamping portion 20. The curvature in the region of the clamping portion 20 is especially provided because the membrane in this region can, due to the there residing higher stability, only yield to a very small degree so that this curvature can be adapted to the convex shape of the outer surface 13 of the rolling piston 10**.

Figure 5:
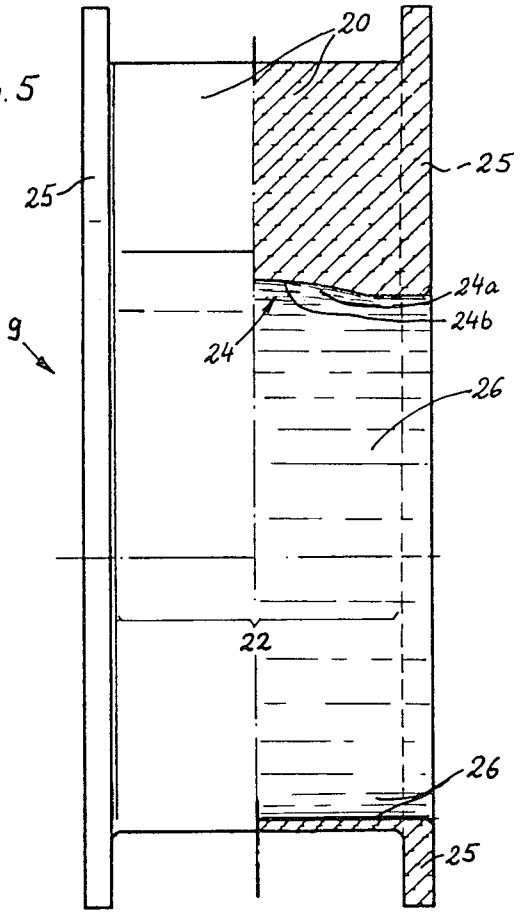
FIG. 5 is a partly sectioned end view of the membrane likewise in undeformed condition, the section being taken along line V—V of FIG. 4.

FIGS. 4 and 5 illustrate the configuration of the membrane 9 in undeformed condition. The clamping portion 20 extends radially outwardly and projects beyond the outer circumference of the remainder of the membrane 9. As shown in FIG. 5, the clamping portion 20 extends over the total axial length of the membrane 9. The membrane 9 is provided to opposite sides of its active circumferential region 22 with about radially oriented, circumferentially extending lateral clamping flanges 25, which project beyond the clamping portion 20. The arching 24 in the region of the clamping portion 20 with the curved space **24*a* and the surface 24*b* limiting the same are also visible in FIGS. 4 and 5. The inner surface 26 of the annular membrane 9** is perfectly smooth so as to present to the rolling piston a substantially jolt-free surface.

The above-mentioned geometrical outline of the membrane 9, especially its form and its diameter, and eventually also the material characteristics of the same are chosen in such a manner that, even if the pump works against an underpressure, the section of the membrane especially in the suction compartment **6*a* thereof will detach itself from the inner surface 7 of the housing. This detachment is further insured in that the outer circumference of the annular membrane 9 in the respective plane is respectively smaller than the inner surface 7 in the respective plane. Thereby it is advantageous that the annular membrane 9 is substantially unextensible in circumferential direction, but slightly extensible in axial direction. For this purpose it is advantageous to embed in the membrane circumferential reinforcements which are, as compared to the material from which the membrane itself is formed, nonextensible, as for instance threads or textile fabrics. Such threads are indicated with a dash-dotted line in FIG. 4 and also indicated in cross-section in FIG. 6. In axial direction the membrane will be subjected to a small extension or elongation due to the fact that the rolling piston 10 will press the membrane 9 into the curvature 39. Such an elongation in axial direction is preferably held to a maximum of less than 4.0 millimeters. Eventually the possibility also exists that the membrane 9 is formed in axial direction slightly longer than corresponds to the length of the curvature 24 in axial direction provided in the outer surface 7 of the housing. In this way it is possible to assure that the membrane 9 remains also in axial direction substantially nonextensible when the rolling piston 10 presses the membrane into the curvature 24 at the surface 7**.

The annular membrane 9 is made from elastic material, preferably an elastomer, and has preferably a thickness of 1 to 4 millimeters.

In order to further reduce wear of the membrane 9, at least the inner surface 7 of the housing and eventually also the outer surface 13 of the rolling piston may be provided with a layer of friction reducing plastic material.

FIGS. 9 and 10 schematically show sectioned side views of the pump 1 with different positions of the rolling piston 10. These Figures also show the respective position of the annular membrane 9, as well as the suction and pressure compartments **6*a*, respectively 6*b*. The direction of movement of the rolling piston 10 is indicated by the arrow Pf3**.

The membrane pump according to the present invention may work without any valves. However, a one-way valve 27 may be provided at the pressure connection 4. The inlet opening 21 and the outlet opening 19 are located closly adjacent the clamping portion 20 of the membrane 9 and separated by the latter from each other.

Due to the symmetrical construction of the membrane pump 1 according to the present invention it is possible to reverse the direction of rotation and therewith also the direction in which fluid is pumped. For this purpose it is only necessary to change the direction of rotation of the drive motor 2 of the pump. For this purpose, the drive motor is preferably a direct current motor.

If the pump is used for pumping hydraulic fluid with an output of about 1 to 100 liters per minute, then the number of revolutions per minute of the pump may be between 500 and 4,000, preferably between 1,000 and 1,800 revolutions per minute.

If the pump is used for pumping a gaseous medium at an output of about 5 to 250 liters per minute, then the pump may be driven with 500 to 4,000 revolutions per minute and preferably with 3,000 to 3,600 revolutions per minute.

The outlet opening 19 of the pump may extend in axial direction through a further distance than in the circumferential direction of the pump. However, it is advantageous when the inlet opening 21 has in the circumferential direction a greater width than in the axial direction. In this way it is possible to favorably influence the output of the pump.

Figure 11:
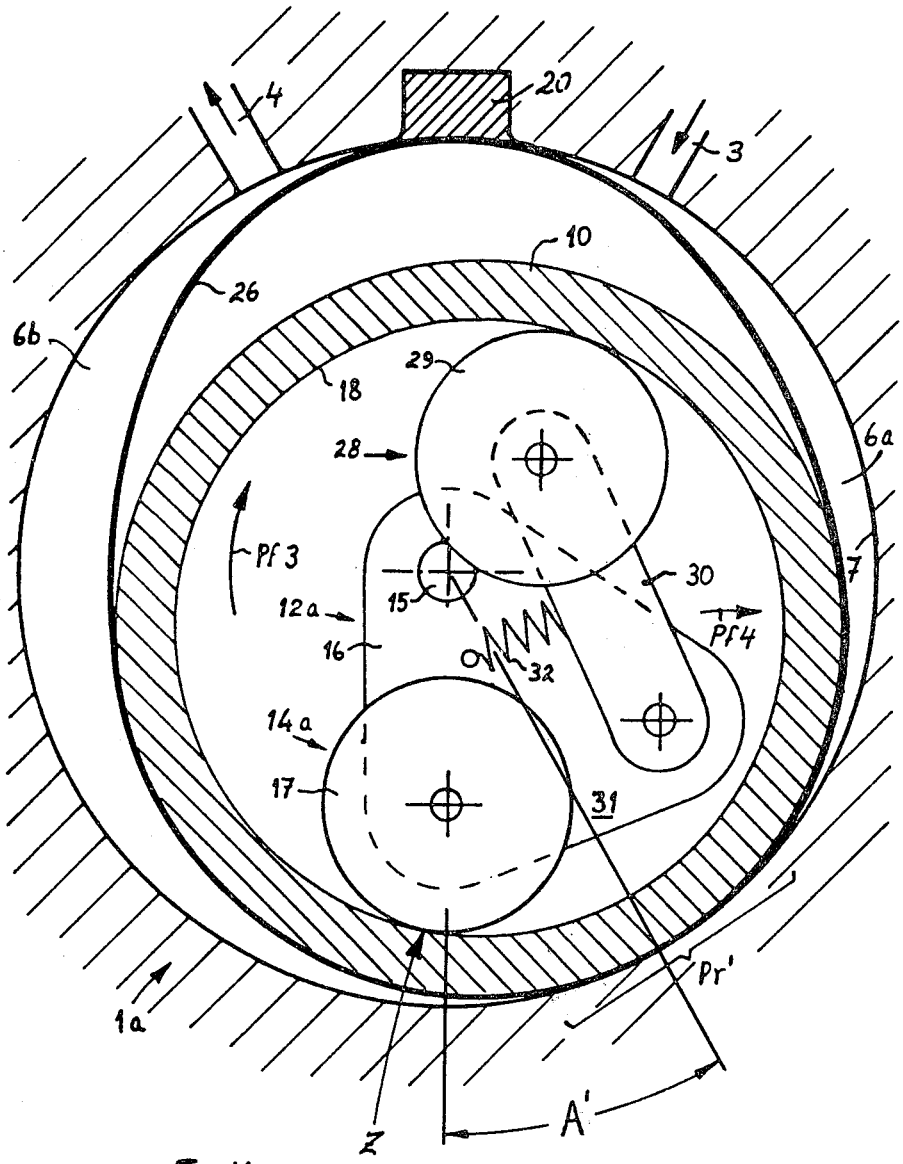
FIG. 11 is a sectioned side view of a modified form of the membrane pump with an auxiliary pressure member.

FIG. 11 shows a modification of the above-described membrane pump in which the eccentric drive 12*a* differs from that shown in FIG. 2. This eccentric drive 12*a* for the rolling piston 10 is provided with an auxiliary pressure member 28 engaging the inner surface 18 of the rolling piston 10 and influencing the tilting movement of the latter in its revolving plane. The auxiliary pressure member 28 is arranged in such a manner to tilt the rolling piston 10 in opposition to its direction of movement as indicated by the arrow Pf3, that is the rolling piston 10 tilts about the tilting point Z in the direction of the arrow Pf4. This will result in an increased pressure in the pressure region Pr' at which the rolling piston 10 presses the annular membrane 9 against the inner surface 7 of the housing. The auxiliary pressure member 28 has a roller especially a ball bearing 29, which in the direction of rotation of the rolling piston drive element 14*a* (arrow Pf3) is arranged after the same, and engaging the inner surface 18 of the rolling piston 10. The ball bearing 29 is mounted for rotation on one end of a lever 30 which is tiltably connected at the other end to the turning arm of the eccentric drive, here shown as a plate 31. The lever 30 is pressed by a spring 32 connected to the arm 16 in a direction so that the roller bearing 29 engages the inner surface 18 of the rolling piston 10.

Different forces will act on the rolling piston 10 depending on the position thereof, whereby the greatest force especially in tilting direction will occur in the lower dead center position of the rolling piston, as substantially shown in FIG. 2. This force will depend among other things on the pressure relationship in the pressure respectively the suction compartments 6*b*, respectively 6*a*. As already mentioned before, a change in the direction of the force acting on the rolling piston will occur in the upper dead center position thereof. In the modification of the membrane pump 1*a* as shown in FIG. 11 the rolling piston 10 is subjected to a pretension in tilting direction in such a manner that the predetermined "trailing engagement" will be maintained. In this way it is possible to avoid any flattering of the rolling piston especially in the region of its upper dead center position. The pretension produced by the auxiliary pressure member 28 may be varied by changing the pressure of the spring 32 or by changing the lever relationship, respectively the point of connection of the lever 30 to the plate 31.

While a circular cross-section of the inner surface 7 of the housing is preferred, it is possible for special applications, for instance for the production of a sealing pressure depending on the position of the rolling piston 10, to give this surface 7 a form deviating from the circular form, for instance, a spiral form. Thereby the trailing angle A respectively A' of the rolling piston and therewith also the sealing pressure will be changed. A higher sealing pressure will result at the smaller distance of the surface 7 from the axis of the drive shaft 15 then at a larger distance of the surface 7 from this axis.

Since the working space 6 is sealed with respect to the rolling piston 10 and the eccentric drive 12 respectively 12*a*, no special sealing means are necessary between the eccentric drive 12, respectively 12*a*, and the pump housing 33. In this way a completely closed working space is created. Eventually it is also possible that the rolling piston drive element 14, especially the ball bearing 17 is encapsulated so that also from there no fat or similar material may be discharged to come in contact with the membrane. It is mentioned also that the pump according to the present invention will operate without oil especially in the region of its working space.

The pump housing 33 is formed by an annular member 34 provided with the surface 7 forming the outer surface of the working space, as well as two housing plates 35. The housing plates 35 and the annular body 34 are provided with cutouts 36 which serve to receive the lateral clamping flanges 25 of the annular membrane 9. The cutouts 36 are dimensioned so that the lateral clamping flanges 25 are tightly clamped at least in axial direction. As shown in FIG. 2 the pump 1 can also be provided with a supporting foot 37*a*.

Figure 13:
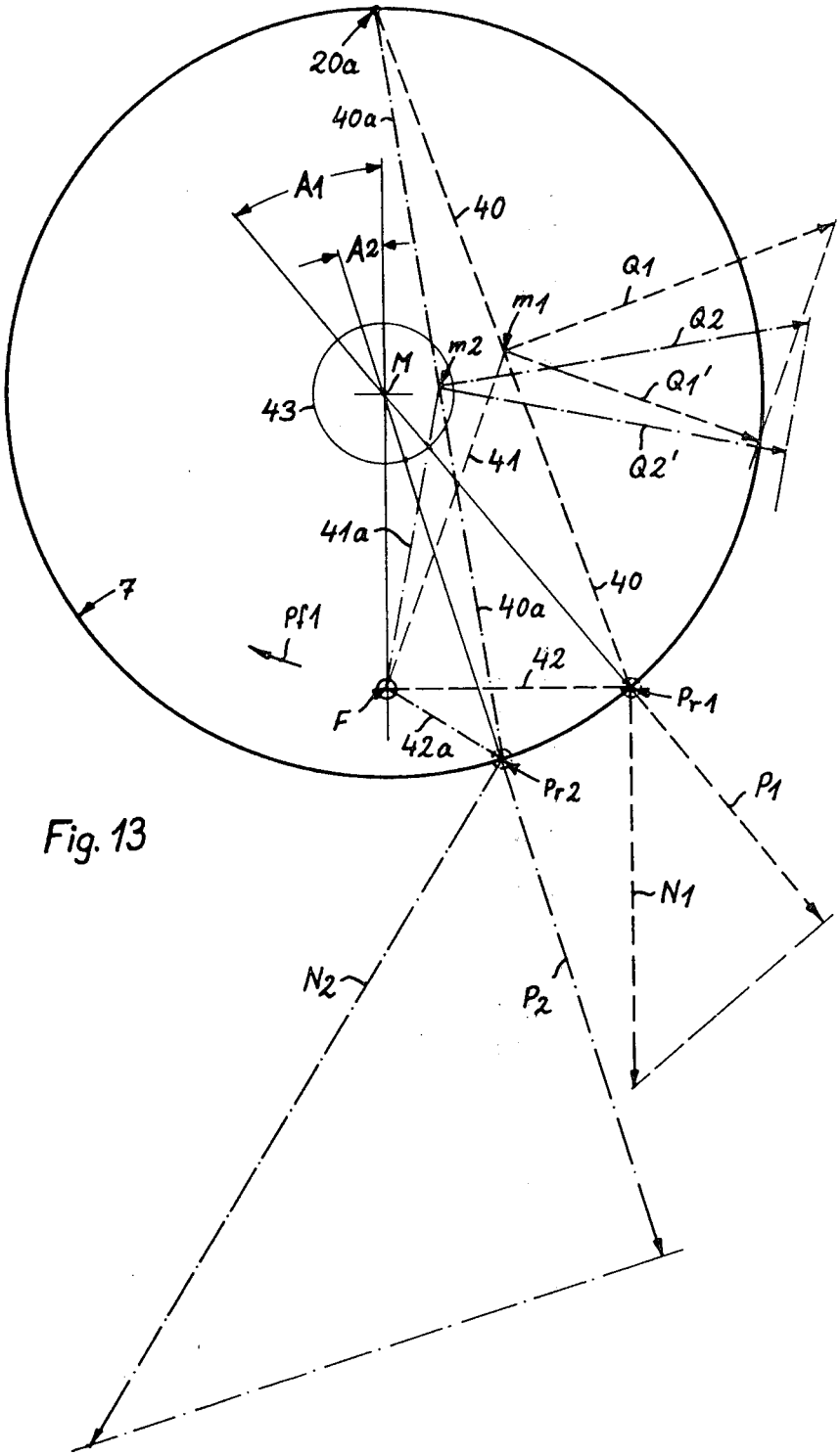
FIG. 13 is a diagram illustrating the pressure condition in the sealing region of the diagram at different trailing angles of the rolling piston.

As already mentioned, the pressure at which the rolling piston 10 is pressed against the annular membrane 9 in the pressure region Pr will depend on the size of the trailing angle A (FIG. 2). FIG. 13 illustrates the pressure relationships for two different trailing angles $A_1$ respectively $A_2$ in the corresponding pressure regions which are shown in FIG. 13 as pressure points Pr1 and Pr2. In FIG. 13 the rolling piston 10, the ball bearing 17 and the membrane 9 are omitted and only the point F at which the ball bearing 17 engages the inner surface 18 of the rolling piston and the sealing points Pr1 and Pr2 at which the membrane is pressed against the inner surface 7 of the housing are shown. The trailing angle $A_1$ is therefore determined between the lines connecting the points F and Pr1 with the point M indicating the axis of the drive shaft and the trailing angle $A_2$ is determined by the lines connecting the points F and Pr2 with the point M. The separation of the pressure space 6*b* from the suction space 6*a* (FIG. 2) by the annular member 9 is schematically indicated in FIG. 13 by the dotted line 40 for the pressure $A_1$ and by the dash-dotted line 40*a* respectively extending between the contact point Pr1 and the sealing point 20*a* provided by the clamping portion 20 of the membrane, respectively between this contact point Pr2 and the sealing point 20*a*.

At first the pressure relationship for the relatively large trailing angle $A_1$ will be considered under consideration of the dotted lines shown in FIG. 13. Thereby half of the length of the separating line 40*a* is as the pressure resultant $Q_1$ shown at the middle m1 of the line 40 extending normal thereto. This pressure resultant $Q_1$ will result from the difference of the pressure in the pressure compartment 6*b* and the suction compartment 6*a* (FIG. 2). The direction of rotation of the rolling piston is assumed in FIG. 13 the same as in FIG. 2 and indicated by the arrow Pf1.

The pressure resultant $Q_1$ forms together with the lever arm 41 between the contact point F and the point $m_1$ a turning moment which among other things causes the tilting of the rolling piston 10. $Q_1'$ designates the force component resulting from the pressure component $Q_1$. The turning moment which acts at a point F will result from the lever arm 41 and the force component $Q_1'$. The same moment acts for the pressure force at the contact point Pr1, however here with a shorter lever arm. The here acting lever arm is indicated as the lever arm 42 between the point F and the contact point Pr1.

At the turning moment predetermined by the lever arm 41 and the force $Q_1'$ there will result normal to the lever arm 42 a force corresponding to the force component $N_1$. From the force component $N_1$ the acting sealing pressure $P_1$ at the contact point Pr1 will be determined by the force diagram shown in FIG. 13.

FIG. 13 shows also the force relationships at the smaller trailing angle $A_2$. The force relationship is illustrated in FIG. 13 by dash-dotted lines. The separation line between the sealing point 20*a* and the contact point Pr2 for the smaller trailing angle $A_2$ is indicated by the dash-dotted line 40*a*. For simplification reason the same position for the engagement point F between the ball bearing and the inner surface of the rolling piston 10 is assumed. $Q_2$ is the corresponding pressure resultant which will give the force component $Q_2'$. The latter gives together with the active lever arm 41*a* the turning moment at the contact point F. The lever arm 42 is, determined by the smaller trailing angle $A_2$ relatively short, so that the turning moment resulting from the force $Q_2'$ as well as the lever arm 41*a* will produce a correspondingly large force component $N_2$ acting on the lever arm 42*a*. From the corresponding force diagram shown in FIG. 13 will result the pressure force P2, that is the sealing pressure acting at the point Pr2. As evident from FIG. 13 the sealing pressure $P_2$ at the smaller trailing angle $A_2$ is essentially greater than the sealing pressure $P_1$ at the larger trailing angle $A_1$. The sealing pressures at which the membrane is pressed by the rolling piston against the outer surface 7 of the housing, is therefore, about inversely proportional to the respective trailing angle. The circle 43 in FIG. 13 indicates the path, the center point of the rolling piston follows, during operation of the pump.

Figure 14:
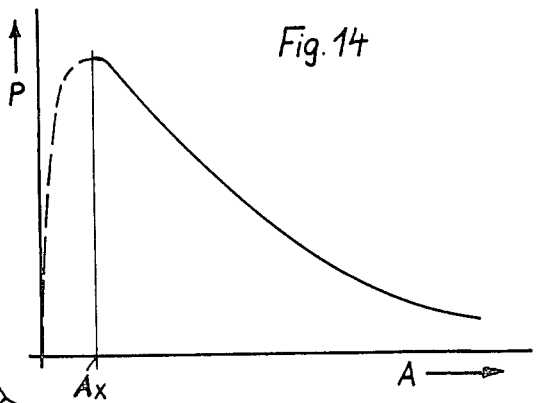
FIG. 14 is a diagram showing the contact pressure in relationship to the trailing angle of the rolling piston.

FIG. 14 illustrates a diagram in which the trailing angle A is entered as variable on the abscissa and the sealing pressure P as the alternate. The illustration is strictly qualitative in order to give an overview of the relationship between trailing angle A and the respective resulting sealing pressure. A not exactly determined transition period for very small trailing angles is shown in dotted lines in FIG. 14, whereas the in FIG. 13 discussed relationships from a predetermined trailing angle $A_x$ are illustrated in FIG. 14 by the full-drawn curve.

As already mentioned, an especially advantageous construction of the membrane 1 or 1*a* of the present invention consists in that the annular membrane 9 has in its individual circumferential section such a circumferential length that the elongation or stretching of the membrane in circumferential direction at all positions of the rolling piston is substantially zero. As further already mentioned such a construction of the annular membrane 9 has the advantage that wear and tear of the same will be reduced and the work to be performed by the pump drive during idling of the pump can be held relatively small. On the other hand, it makes it also possible to reinforce the annular membrane in circular direction by reinforcing threads 38. This will further increase the stability and the useful life obtainable from the annular membrane.

Figure 15:
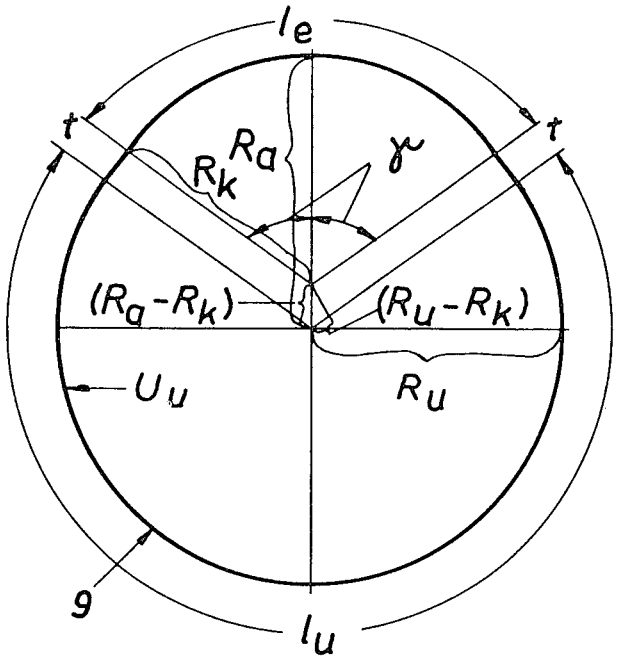
FIGS. 15–18 are schematic illustrations of the diaphragm for the calculation of the diaphragm sections.

In order to provide the annular membrane 9 with such dimensions according to the present invention, it is possible to calculate the individual circumferences U of the membrane in different cross-sectional planes. Eleven such cross-sectional planes are shown in FIG. 6 and respectively designated with QO, QI, QII, QIII, QIV, and QV. Thereby, the plane QO is located in a plane of symmetry of the annular membrane 9, whereas the other mentioned planes are respectively located to opposite sides of the central plane QO symmetrically with respect thereto. Thereby FIG. 15 shows the geometry of the "neutral zone" which corresponds to that zone in the actual membrane 9 in which the threads 38 (FIGS. 4 and 6) are located, whereby in FIG. 15 the membrane is shown in untensioned condition not engaged by the rolling piston 10. Thereby, the length of the circumference $U_u$ when not engaged by the rolling piston is according to FIG. 15

$$U_u = l_e + 2t + l_u$$

and as can be visualized from FIG. 15 there will result the following geometrical relationships:

$$l_e = \frac{2\pi}{360} R_k \cdot 2\gamma$$

$$t = \sqrt{(R_a - R_k)^2 - (R_u - R_k)^2}$$

$$l_u = \frac{2\pi}{360} R_u (360 - 2\gamma)$$

$$\tan\gamma = \frac{t}{R_u - R_k}$$

Thereby the dimension $R_k$ illustrates the distance from the center of the rolling piston to the aforementioned neutral zone in which the threads 38 are located.

The angle $\gamma$ can be chosen according to the already discussed principles and this angle may eventually be varied. The same applies for the radii $R_a$ and $R_u$.

Figure 16:
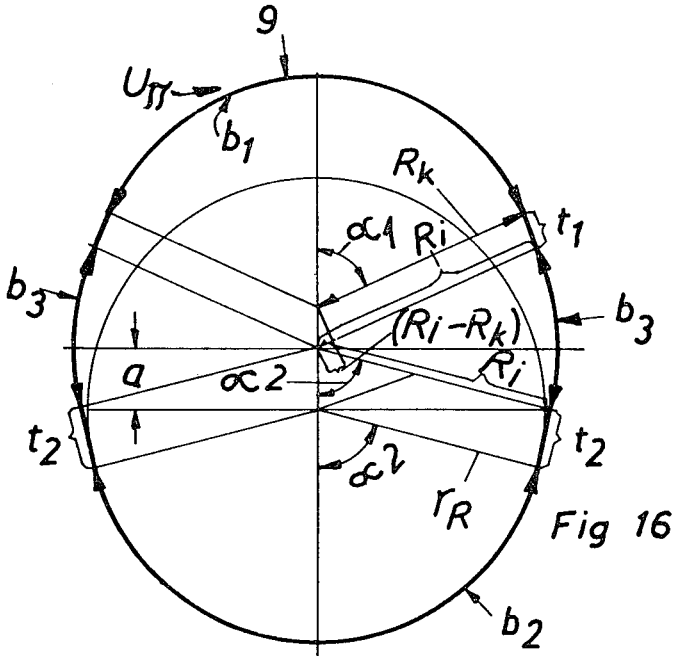

FIG. 16 illustrates the circumference $U_\pi$ of the neutral zone of the membrane 9 according to FIG. 15, but in a position in which the membrane is deflected by the rolling piston 10, thereby the rolling piston is in the angular position $\pi$.

For the circumference of the neutral zone designated with $U_\pi$ the following relationships are applicable:

$$U_\pi = b_1 + b_2 + 2(b_3 + t_1 + t_2).$$

Thereby:

$$b_1 = \frac{2\pi R_k}{360} 2\alpha_1$$

$$t_1 = \sqrt{(R_a - R_k)^2 - (R_i - R_k)^2}$$

$$b_2 = \frac{2\pi r_R}{360} \cdot 2\alpha_2$$

$$t_2 - \sqrt{a^2 - (R_i - r_R)^2}$$

-continued $$b_3 = \frac{2\pi R_i}{360} \cdot 180 - (\alpha_1 + \alpha_2)$$

$$\sin \alpha_1 = \frac{t_1}{R_a - R_k}$$

$$\sin \alpha_2 = \frac{t_2}{a}$$

The above relationships can be determined from FIG. 16.

FIGS. 17 and 18 again illustrate the circumference U of the neutral zone of the annular membrane for the positions $\pi/2$, respectively $3/2\ \pi$ of the rolling piston. Thereby the following relationships apply:

$$U_{/2} = U_{3/2} = b_1 + b_2 + b_3 + b_4 + b_5 + t_1 + t_2 + t_3$$

$$b_1 = \frac{2\pi R_k}{360} \alpha_1$$

$$t_1 = \sqrt{(R_a - R_k)^2 - (R_i - R_k)^2}$$

$$b_2 = \frac{2\pi R_i}{360} 270 - (\alpha_1 + \alpha_2)$$

$$t_2 = \sqrt{a^2 - (R_i - r_R)^2}$$

$$t_3 = \sqrt{(R_a - R_k)^2 + a^2 - (R_k - r_k)^2}$$

$$b_3 = \frac{2\pi r_R}{360} \alpha_2$$

$$b_4 = \frac{2\pi r_R}{360} 90 - (\beta_3 + \beta_6)$$

$$b_5 = \frac{2\pi R_k}{360} 180 - (\alpha_3 + \alpha_6)$$

$$\sin \alpha_1 = \frac{t_1}{R_a - R_k}$$

$$\sin \alpha_2 = \frac{t_2}{a}$$

$$\tan \alpha_3 = \frac{a}{R_a - R_k}$$

$$\alpha_4 = 90 - (\beta_3 + \beta_6)$$

$$\alpha_5 = 180 - (\alpha_3 + \alpha_6)$$

$$\sin \alpha_6 = \frac{R_k - r_R}{\sqrt{(R_a - R_k)^2 + a^2}}$$

$$\beta_3 = 90 - \alpha_2$$

$$\beta_6 = 90 - \alpha_6$$

Figure 17:
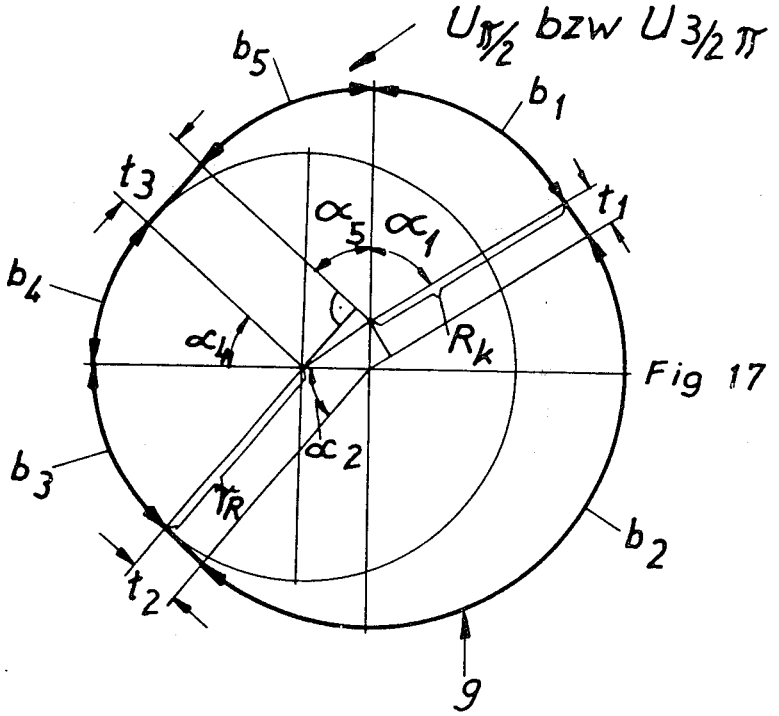
Figure 18:
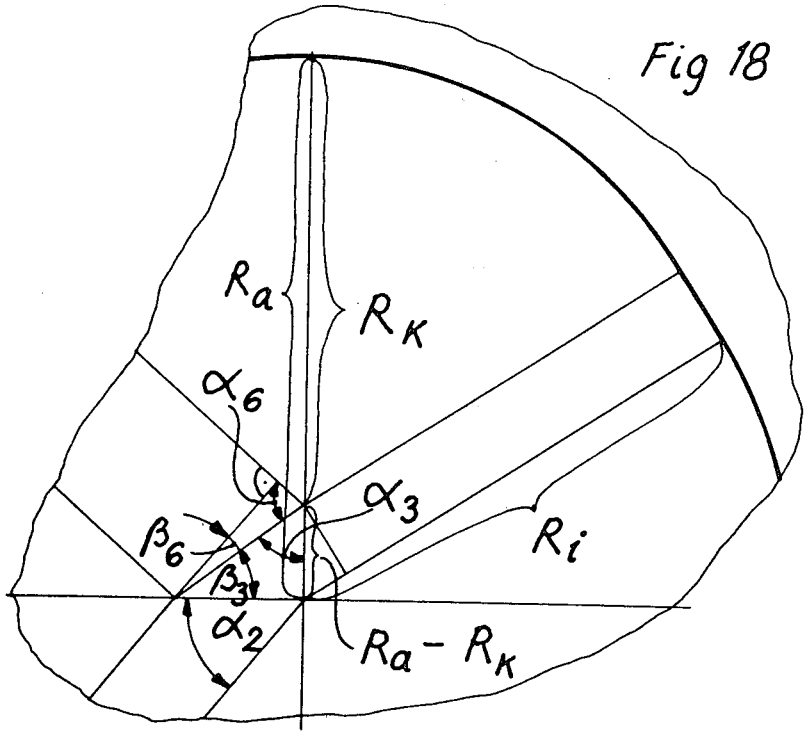

The above relationships can be determined from FIGS. 17 and 18.

It is thus for instance possible by predetermined radii $R_a$ and $R_u$ to calculate by calculus variations at which variable dimensions the circumference U of the neutral zone of the membrane 9 in all positions of the rolling piston in the respective sections QO, QI, and so on are practically the same. The sameness of the circumference in the aforementioned cross-section planes QO, QI, and so on, of the membrane 9 means that the elongation, respectively the loading of the membrane in all positions of the rolling piston 10 will practically be zero.

The special construction of the membrane form as especially provided by the bulging 24 (see for instance FIGS. 4, 5 and 7) are disregarded by the above strictly theoretical geometrical considerations.

The comments made in connection with FIGS. 15–18 show that it is possible to create an annular membrane 9 which theoretically in all positions of the rolling piston 10 is substantially tensionless.

With regard to FIG. 2 the following is further mentioned. As can be seen from this Figure, the point of engagement F of the ball bearing 17 with the inner surface 18 of the rolling piston 10 and the pressure region Pr at which the membrane 9 is pressed by the outer surface of the rolling piston against the inner surface 7 of the housing are respectively located to opposite sides of the center plane of the arm 16. This displacement of the engaging points relative to the assembly position as shown in FIG. 12 will result from the tilting of the rolling piston 10. The engagement point F is displaced in the direction of rotation of the arm 16, whereas the contact region Pr trails the movement of the arm 16.

Figures 19, 20, 21:
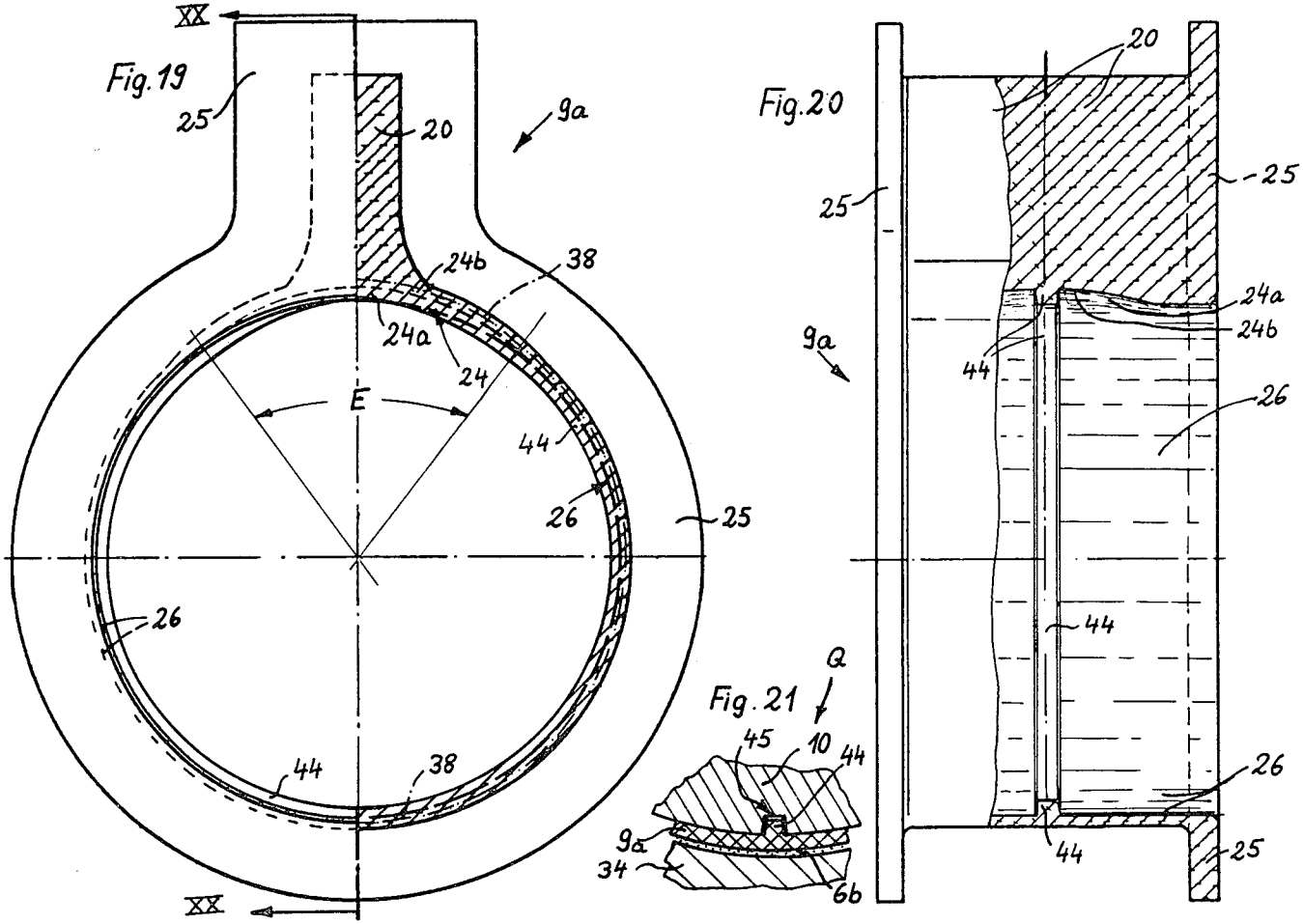
FIGS. 19 and 20 correspond to the views shown FIGS. 4 and 5 of an annular membrane which is however provided with an annular bead.
FIG. 21 illustrates the cross-section of the detail view indicated in FIG. 3 by the dash-dotted circle in which however the membrane is provided with an annular bead.

FIGS. 19 and 20 illustrate a membrane 9*a* which differs slightly from that shown in FIGS. 4 and 5 in that the membrane 9*a* is provided with a circumferentially extending bead 44 as a reinforcement. The bead 44 projects from the inner surface 26 of the annular membrane 9*a* and the rolling piston 10 to be used with the annular membrane 9*a* is provided with an annular groove 45 (FIG. 21) in which the bead 44 is engaged. The annular groove 45 has a cross-section at least corresponding to that of the bead 44.

In the embodiment shown in FIGS. 19–21 the annular membrane 9*a* has a single bead 44 arranged in a center plane of the membrane. It is however, also possible to provide a plurality of such beads 44 on the inner surface of the annular membrane 9. The bead 44, respectively a plurality of such beads, are dimensioned as to the cross-section thereof and with respect to the moment of inertia in such a manner that the portions of the membrane not engaged by the rolling piston will be drawn away from the inner surface 7 of the housing. This is obtained by the reduction of the extensibility of the annular membrane 9*a* by the bead. Such bead or beads 44 have therefore a similar function as the threads 38 shown in FIG. 6. While FIGS. 20 and 21 show also that the bead 44 is substantially of trapezoidal shape tapering against the inner free end of the bead, whereby the entrance of the bead into the annular groove 45 of the rolling piston 10 is facilitated.

The annular membrane 9*a* with the bead 44 is constructed in such a manner that the deformation work is as small as possible so that the various membrane portions are positively disengaged from the inner surface 7 of the housing even if the pump sucks a gaseous medium out of a vacuum. The annular membrane 9*a* with the bead may be manufactured in a simpler manner than a membrane with threads 38 embedded therein.

Due to the tiltable arrangement of the rolling piston 10 it is possible to compensate for manufacturing tolerances of the rolling piston and on the annular body 34 of the housing so that the pump housing 33 respectively the annular portion 34 thereof and/or the rolling piston 10, preferably both pump parts, may be manufactured as molded parts. Especially these parts may be formed from die-cast metal without further machining. The thereby resulting tolerances of the rolling piston and the housing, especially deviations from the circular form may be compensated for by the tilting of the rolling piston 10. Thus the aforementioned elements of the membrane pump may be manufactured at very reasonable cost.

However, it is also possible to produce the aforementioned pump parts, that is the rolling piston 10 and the pump housing 33, especially the annular part 34 thereof, from plastic material, whereby these parts are preferably made by injection molding. Such pumps may be used for small output and if the fluid pump is not of high temperature.

It will be understood that each of the elements described above, or two or more together, may also find a useful application in other types of membrane pumps differing from the types described above.

While the invention has been illustrated and described as embodied in a membrane pump having an annular membrane which is pressed by a roller element on an eccentric drive against the annular inner surface of a housing and in which the rolling element is tiltably arranged with regard to this surface, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a membrane pump, a combination comprising a housing having an axis and an inner annular surface extending about said axis; an annular membrane within said housing and having an outer surface defining with said inner surface of said housing an annular working space; and means rotatable in a predetermined direction for pressing the outer surface of said annular membrane at a revolving sealing region against said inner surface of said housing, said rotatable means comprising an annular rolling piston having an inner surface and rigid eccentric drive means engaging said inner surface of said rolling piston with a line contact, wherein in any radial plane including the axis of said housing and the respective line of contact the outer radius of said eccentric drive means plus the wall thickness of said annular piston plus the wall thickness of said membrane is slightly smaller than the radius of said inner surface of said housing so as to provide a small clearance between the outer surface of said membrane and said inner surface of said housing, whereby during rotation of said rotatable means said rolling piston will tilt with respect to said eccentric drive means and said inner surface of said housing to press a portion of said annular membrane angularly displaced from said line of contact and forming said sealing region against the inner surface of said housing.

2. A combination as defined in claim 1, wherein said small clearance is in the order of 0.1 to 0.5 millimeters.

3. A combination as defined in claim 1, wherein said membrane has a shape and diameter so that the membrane remains in nearly all positions of the rolling piston relative thereto substantially free of tension.

4. A combination as defined in claim 1, wherein said annular membrane is formed from elastomer and has a thickness of about 1–4 millimeters.

5. A combination as defined in claim 1, wherein said annular membrane is substantially inextensible in circumferential direction but flexible in radial direction.

6. A combination as defined in claim 1, and including substantially inextensible reinforcements embedded in said membrane.

7. A combination as defined in claim 1, wherein said membrane is fixed at a small region to said outer housing and wherein said membrane has outside said small region a substantially uniform wall thickness.

8. A combination as defined in claim 7, wherein the line of contact of said eccentric portion of said eccentric drive means with said inner surface of said hollow piston is circumferentially spaced from the center of the region at which said membrane is pressed against the inner surface of said housing through an angle of 1°–40° trailing with respect to the direction of rotation of said rotatable means.

9. A combination as defined in claim 8, wherein said membrane has a radially directed clamping portion projecting from the outer surface thereof and being fixed in a corresponding cutout of the housing, wherein said housing is provided to opposite sides of said clamping portion with an inlet opening and an outlet opening, and wherein the circumferential angle between a center line of the clamping portion and a center line of said outlet opening is greater than the trailing angle between the point of engagement of said eccentric portion with the inner surface of said rolling piston and the center of the region at which said membrane is pressed against the inner surface of said housing, and wherein said trailing angle in turn is smaller than the angle at which said clamping portion extends in the circumferential direction of said housing.

10. A combination as defined in claim 8, wherein said membrane forms with said inner surface of said housing between said fixed region and the region at which said membrane is pressed against said inner surface of the housing a suction compartment at one side of said fixed region and a pressure compartment at the other side of said fixed region, and wherein said membrane has a shape and is formed from a material such that, even if the pump operates at a pressure less than atmospheric pressure, the outer surface of the membrane remains in the suction compartment spaced from the inner surface of the housing.

11. A combination as defined in claim 7, wherein the eccentric drive means comprises a drive shaft turnably mounted about said axis of the housing, a radially extending arm fixed at one end to said drive shaft and a roller bearing turnably mounted on the other end of said arm and engaging the inner surface of said hollow piston.

12. A combination as defined in claim 1, wherein said inner surface of said housing has in an axial plane of said pump a concave curvature and wherein the outer surface of said rolling piston has in said plane a correspondingly convex curvature.

13. A combination as defined in claim 12, wherein said membrane has a radially directed clamping portion projecting from the outer surface thereof and fixed to a corresponding cutout in said housing, said clamping portion extending over the whole axial length of said membrane.

14. A combination as defined in claim 13, wherein said inner surface of said membrane presents to the outer surface of said rolling piston a smooth surface.

15. A combination as defined in claim 13, wherein said housing comprises an annular central portion provided at said inner surface with said concave curvature and a pair of opposite side walls, and wherein said membrane has opposite radially extending flanges extending circumferentially at least up to said clamping portion and being respectively clamped between said central portion and said side walls of said housing.

16. A combination as defined in claim 13, wherein said housing is formed at opposite sides of said clamping portions respectively with an inlet and an outlet opening separated from each other by said clamping portion.

17. A combination as defined in claim 16, wherein the included angle between said inlet and said outlet opening is only slightly smaller than the distance through which said clamping portion extends in circumferential direction.

18. A combination as defined in claim 13, wherein said membrane has, in unstressed condition, a substantially pear-shaped form in axial cross-section with a portion of said membrane in said region of said clamping portion having a radius of curvature smaller than the radius of curvature of the portion opposite said clamping portion.

19. A combination as defined in claim 18, wherein the larger radius of curvature of the membrane is smaller than the radius of said inner surface of said housing but larger than the outer radius of said rolling piston, and wherein said smaller diameter of said membrane is at most equal to the outer radius of said piston.

20. A combination as defined in claim 18, wherein the portion of the membrane having said larger radius of curvature has in axial direction and in unstressed condition a straight cylindrical inner surface and in the region of the clamping portion an inner surface curved concavely corresponding to the concavely curved inner surface of said housing, and wherein said portion of smaller radius curves axially to opposite sides of said clamping portion gradually from a straight cylindrical surface to the curvature at said clamping portion.

21. A combination as defined in claim 18, wherein said portion having said smaller radius of curvature extends through an angle of about 70° and including connecting portions between said portion of smaller radius of curvature and said opposite portion of larger radius of curvature, said connecting portions forming a smooth transition between said first two mentioned portions.

22. A combination as defined in claim 19, wherein said larger radius of curvature is constructed so that the membrane in the region of said larger radius will remain substantially tensionless in circumferential direction and under consideration of the desired output of the pump.

23. A combination as defined in claim 12, wherein the maximum stretching of the membrane in axial direction of said pump is less than 4.0 millimeter.

24. A combination as defined in claim 23, wherein said membrane has in the axial direction of said pump such a length so that it will remain substantially unstretched in said direction when pushed by said rotating piston into the concavely curved inner surface of said housing.

25. A combination as defined in claim 24 and including reversible drive means for turning said rotatable means in said one or in the opposite direction.

26. A combination as defined in claim 25, wherein said reversible drive means comprises a reversible direct current motor.

27. A combination as defined in claim 1, wherein said inner surface of said housing is covered with a smooth layer of plastic material.

28. A combination as defined in claim 27, wherein the outer surface of said rolling piston is also covered with a smooth layer of plastic material.

29. A combination as defined in claim 1, wherein said eccentric drive means further includes an auxiliary pressure member engaging the inner surface of said rolling piston and being arranged to tilt said rolling piston in the direction in which the latter revolves on the inner surface of said membrane.

30. A combination as defined in claim 29, wherein said auxiliary pressure member comprises a roller arranged downstream of said eccentric portion as considered in the direction of movement of said rolling piston on the inner surface of said membrane.

31. A combination as defined in claim 30, wherein said eccentric drive means comprises a drive shaft turnably mounted in said housing coaxial with the axis thereof, a radially extending arm fixed at one end to the drive shaft in the interior of said hollow piston and a roller bearing turnably mounted on said other end of said arm and engaging the inner surface of said rolling piston, and including a lever turnably mounted on end on said arm and carrying at its other end said roller, and biasing means between said arm and said lever for biasing said roller into engagement with the inner surface of said rolling piston.

32. A combination as defined in claim 1, wherein said annular membrane is provided with a reinforcement in form of at least one annular bead.

33. A combination as defined in claim 32, wherein said at least one annular bead is provided at the inner surface of said membrane and wherein said rolling piston is provided with at least one annular groove for the passage of said at least one annular bead therethrough.

34. A combination as defined in claim 33, wherein said membrane has a single annular bead arranged symmetrically with respect to a central plane of symmetry of said membrane.

35. A combination as defined in claim 33, wherein the cross-section and the moment of inertia of said at least one annular bead are determined so as to draw the circumferential portions of the membrane which are not engaged by said rolling piston away from said inner surface of said housing.

* * * * *